US005338718A

United States Patent [19]

Sato et al.

[11] Patent Number: 5,338,718

[45] Date of Patent: Aug. 16, 1994

[54] THERMAL TRANSFER SHEET AND THERMAL TRANSFER IMAGE FORMING METHOD

[75] Inventors: Hideaki Sato; Hiroshi Eguchi, both of Tokyo, Japan

[73] Assignee: Dai Nippon Printing Co., Ltd., Japan

[21] Appl. No.: 857,614

[22] Filed: Mar. 25, 1992

[30] Foreign Application Priority Data

Mar. 26, 1991 [JP] Japan ..... 3-84431
Mar. 26, 1991 [JP] Japan ..... 3-84433

[51] Int. Cl.[5] ..... B41M 5/035; B41M 5/38

[52] U.S. Cl. ..... 503/227; 428/195; 428/913; 428/914

[58] Field of Search ..... 8/471; 428/195, 913, 428/914; 503/227

[56] References Cited

FOREIGN PATENT DOCUMENTS

| | | | |
|---|---|---|---|
| 0399673 | 11/1990 | European Pat. Off. | 503/227 |
| 0229793 | 11/1985 | Japan | 503/227 |
| 61-83083 | 4/1986 | Japan | 428/195 |
| 63-57292 | 3/1988 | Japan | 503/227 |
| 63-77786 | 4/1988 | Japan | 428/195 |
| 1249377 | 10/1989 | Japan | 428/195 |

*Primary Examiner*—B. Hamilton Hess
*Attorney, Agent, or Firm*—Ladas & Parry

[57] ABSTRACT

A thermal transfer sheet comprising a substrate film and a dye layer containing a dye and a binder, said dye layer including two or more sarts of dye layer with respect to one and the same hue. Using the thermal transfer sheet, an image with little color difference in desired gradation levels can be provided.

11 Claims, 2 Drawing Sheets

THERMAL TRANSFER SHEET AND THERMAL TRANSFER IMAGE FORMING METHOD

BACKGROUND OF THE INVENTION

The present invention relates to a thermal transfer sheet and a thermal transfer image forming method, more particularly to a thermal transfer sheet and a thermal transfer image forming method for providing an image of high quality with little color difference in the gradation of an image using sublimable dyes (thermally migrating dyes) in the method thereof.

In recent years, there have been developed some printing methods for providing excellent mono-color or full-color images conveniently at high speed such as an ink jet method and a thermal transfer method replacing conventional ordinary offset printing and other printing methods. Above them, a so-called sublimation thermal transfer method using sublimable dyes is most distinguished, which can provide a full-color image superior in the gradation characteristic as excellently as a color photography.

In this sublimation thermal transfer method is usually used a thermal transfer sheet comprising a substrate film such as a polyester film, a dye layer containing a sublimable dye and a binder formed on one surface side of the substrate and a heat resistant layer formed on the other surface side of the substrate for preventing a thermal print head sticking thereto.

The thermal transfer sheet is superposed on an image-receiving sheet having a dye receptor layer made of e.g. polyester resin with the dye layer of the former sheet facing the latter sheet and imagewise heated from the back surface side of the former sheet by means of the thermal print head, which causes the dye of the dye layer to transfer to the image receiving sheet to thereby form a desired image.

In the above thermal transfer method, when a color image is formed by three or four colors, colors except yellow, magenta and cyan are reproduced by way subtractive mixture of these three primary colors. Such medium colors and black are sufficiently reproduced by suitable selection and combination of respective dyes of yellow, magenta and cyan; for example, black is reproduced by blending these three colors. However there rises a problem that black, sufficiently reproduced in a shadow area, is often reproduced rather reddish or bluish in a highlight area. The reason is that the arrangement of the three colors is determined for black to be most sufficiently reproduced in a shadow area. Reversely, if the arrangement of three colors is determined for black to be excellently reproduced in a highlight area, black in the shadow area cannot be sufficiently reproduced. Such problem occurs likewise in cases of other medium colors such as green, red and blue, which is an obstacle in color reproduction process for forming images superior in the gradation characteristic.

Another problem is that, where two or more dyes are overlapped to reproduce a subtle tone color using prior thermal transfer sheets of yellow, magenta and cyan, the printing energy control is required for each color of them according to each level of density thereof. A conventional printer, however, does not have a capacity enough to store and process such enormous data for controlling the printing energy. On the other hand, if the data is simplified so as to be processed even by the conventional printer, it stands to reason that a subtle tone color cannot be well reproduced.

SUMMARY OF THE INVENTION

A principal object of the present invention is to solve the above mentioned problems in the prior art and to provide a thermal transfer sheet and a thermal transfer image forming method superior in reproduction of medium tone colors.

More specifically, the invention includes, first, a thermal transfer sheet comprising a substrate film and a dye layer containing a dye and a binder, said dye layer including two or more sorts of dye layers with respect to one and the same hue.

The invention Secondly includes a thermal transfer sheet comprising a substrate film and a dye layer containing dyes and a binder, said dye layer containing two or more sorts of dyes.

The invention includes, thirdly, a thermal transfer image forming method, comprising; superposing a thermal transfer sheet having a dye layer containing dyes and a binder formed on a substrate film on an image-receiving sheet, and supplying imagewise heat to the thermal transfer sheet from the back surface side of the substrate film to form an image on the image-receiving sheet, wherein two or more sorts of thermal transfer sheets including, respectively, different dye layers with respect to one and the same hue are arranged, and each area of the shadow and the highlight in the same hue of the image is provided using each different thermal transfer sheets mentioned above.

BRIEF DESCRIPTION OF THE INVENTION

DETAILED DESCRIPTION OF PREFERRED EMBODIMENT

Referring now to a preferred embodiment, the present invention will be described in detail below.

Figure 1:
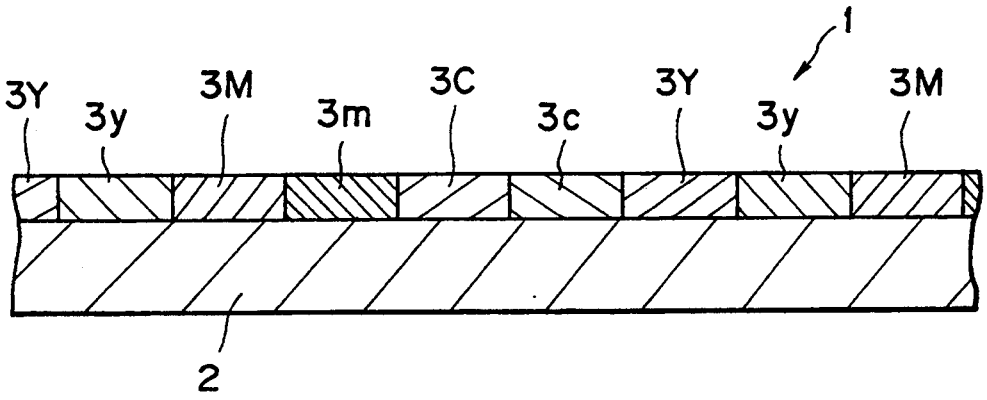
FIG. 1 is a schematic sectional view of a thermal transfer sheet according to the present invention.

FIG. 1 is a schematic section showing an embodiment of a thermal transfer sheet of this invention. As shown in FIG. 1, the thermal transfer sheet 1 of the invention comprises a substrate film 2 and a dye layer 3 formed on one surface side of the substrate film 2. The dye layer includes two sorts of dye layers, i.e., one sort for providing a shadow area and the other sort for providing a highlight area of one and the same hue in each color of yellow, magenta and cyan. More specifically, the dye layer 3 includes a yellow dye layer comprising a shadow yellow layer 3Y and a highlight yellow layer **3*y*, a magenta dye layer comprising a shadow magenta layer 3M and a highlight magenta layer 3*m* and a cyan dye layer comprising a shadow cyan layer 3C and a highlight cyan layer 3*c*. The respective dye layers of 3Y, 3*y*, 3M, 3*m*, 3C and 3*c* are arranged sequentially in the named order to compose the dye layer 3**.

Hereupon, the above mentioned shadow area and highlight area may be differentiated from each other according to optical density (OD), for example; an area of $OD \geqq 1$ may be determined as a shadow area and an area of $0 \leqq OD \leqq 1$ as highlight area.

When an image is provided in an image-receiving sheet using the thermal transfer sheet 1 mentioned above, a shadow area of the image is provided by selecting three shadow colors layers 3Y, 3M and 3C, while a highlight area of the image is provided by selecting three highlight colors layers **3*y*, 3*m* and 3*c*, so that the resultant image can have a high quality with little color difference whether in a shadow area or in a highlight area. Various experiments may easily find suitable selections and combinations of dyes for these two sets of three colors dye layers. The thermal transfer sheet of this invention is not limited to include two sets of three colors dye layers but additionally may include three colors dye layers for providing a medium density area (e.g., OD=1). The respective dye layers may not be necessarily arranged in the order mentioned above, but may be arrayed in an order such as 3Y→3M→3C→3*y*→3*m*→3*c*** or in other orders.

The substrate film 2 of the thermal transfer sheet 1 of this invention may be any one used in the conventional thermal transfer sheet having suitable strength and heat resistant property. Take for instance, paper having a thickness of 0.5 to 50 μm, more preferably 3 to 10 μm, various kinds of converted paper, polyester film, polystyrene film, polypropylene film, polysulphone film, aramid film, polycarboante film, polyvinylalcohol film and cellophane. Among them, polyester film is most preferred. These substrate films may be leaf like ones or contiguous ones without any specific restriction.

The dye layer 3 formed on one surface side of the substrate film has a dye carried on a binder resin.

The dye used for the invention may be any of dyes usable in the conventional thermal transfer sheet and is not particularly restricted. Preferred examples of such a dye may include: red dyes such as MS Red G, Macrolex Red Violet R, Ceres Red 7B, Samaron Red HBSL, Resolin Red F3BS; yellow dyes such as Foron Brilliant Yellow 6GL, PTY-52, Macrolex Yellow 6G; and blue dyes such as Kayaset Blue 714, Waxolin Blue AP-FW, Foron Brilliant Blue-S-R, and MS Blue-100.

As a binder resin for carrying the above mentioned dye, any of known binders is usable. Preferred examples thereof may include: cellulose resins such as ethylcellulose, hydroxyethyl cellulose, ethylhydroxycellulose, hydroxypropyl cellulose, methylcellulose, cellulose acetate and cellulose acetate butyrate; vinyl type resin such as polyvinyl alcohol, polyvinyl acetate, polyvinyl butyral, polyvinyl acetal, polyvinyl pyrolidone and polyacrylamide; and polyester resin. Among them, cellulose resins, acetal type resins, butyral type resins and polyester type resins are particularly preferred in view of heat resistance and dye transferability. The dye layer 3 may further contain any of various additives known in the prior art, if required.

The dye layer 3 may be formed preferably by dissolving or dispersing the above-mentioned sublimable dye, binder resin and release agent, and other optional components in an appropriate solvent to prepare a dye layer forming material or ink, coating the above mentioned substrate film with this dye layer forming material and drying the resultant coating.

The thus formed dye layer 3 may have a thickness of about 0.2 to 5.0 μm, preferably about 0.4 to 2.0 μm. The sublimable dye content in the dye layer 3 may be 5 to 90 wt. %, preferably 10 to 70 wt. % based on the weight of the dye layer 3.

In the embodiment mentioned above, the dye layer 3, composed of three colors dye layers of yellow, magenta and cyan, can provide a full-color image. The dye layer 3 may further comprise a black layer, if required. When a monocolor image is desired, the dye layer 3 may be formed of one color dye selected from the dyes of these colors.

Further according to the present invention, an intermediate layer may be disposed between the substrate film 2 and the dye layer 3 with a view to increasing the adhesion property and enhancing the cushioning function. The intermediate layer may be formed of a resin such as polyurethane resin, acrylic resin, polyethylene type resin, butadiene rubber or epoxy resin, and preferably have a thickness of 0.1 to 5 μm. The forming process thereof may be the same as described with respect to the dye layer.

Figure 2:
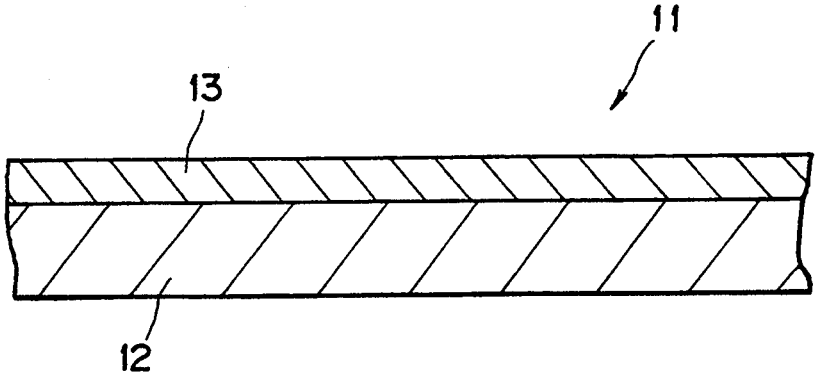
FIG. 2 is a schematic sectional view of another thermal transfer sheet according to the present invention.

FIG. 2 is a schematic sectional view showing another embodiment of the thermal transfer sheet according to the invention.

Referring to FIG. 2, the thermal transfer sheet 11 of the invention comprises a substrate film 12 and a dye layer 13 formed on one surface side of the substrate film 12. The dye layer 13 contains a binder and a dye, which consists of two or more sorts of dyes.

The two or more sorts of dyes may be selected and combined suitably for reproducing a desired color of an image. For example, a combination of dyes such as yellow and magenta, magenta and cyan, or cyan and yellow can be determined. Each dye content in the dye layer can be also optionally determined.

The substrate film 12 and a binder and a dye used in the dye layer 13 can be selected from the substrate films and the sublimable dyes and the binder resins mentioned in the first embodiment, respectively. Also, the thickness of the dye layer 13 and the sublimable dye content in the dye layer 13 may be substantially the same as described with regard to the first embodiment.

When a green mono color image is provided by using the above-mentioned thermal transfer sheet 11 comprising a green dye layer consisting of a yellow dye and cyan dye, the resultant green image is superior to a green mono-color image formed by overlapping two thermal transfer sheets, i.e. yellow dye sheet and cyan dye sheet each other, because the image formed by this invention has an excellent hue closer to the ideal hue in every gradation.

An image-receiving sheet used correspondingly to the above mentioned thermal transfer sheet 1, 11 may be any one of those comprising a recording surface having a dye receptivity to the above mentioned dyes. In a case where the image-receiving sheet is made of a material having no dye receptivity such as paper, metal, glass, or plastic, a dye receptor layer may be formed on at least one surface side of the image-receiving sheet.

A thermal transfer image forming method will be now explained according to the present invention.

A thermal transfer sheet to be used in the thermal transfer image forming method of the invention comprises a dye layer, by the medium of an intermediate layer, if required, on a substrate film, basically having the same configuration as of a prior art.

Such a thermal transfer sheet can be provided using materials suitably selected from the substrate films, the dyes and the binder resins usable in the thermal transfer sheet mentioned in the first embodiment.

When a mono-color image is desired, the dye layer therefor is formed of one color dye selected from those mentioned above. On the other hand, when a full-color image is desired, dye layers of yellow, magenta and cyan (plus black, if required) are formed by selecting from appropriate dyes of yellow, magenta and cyan, (plus black, if required), respectively.

Figure 3:
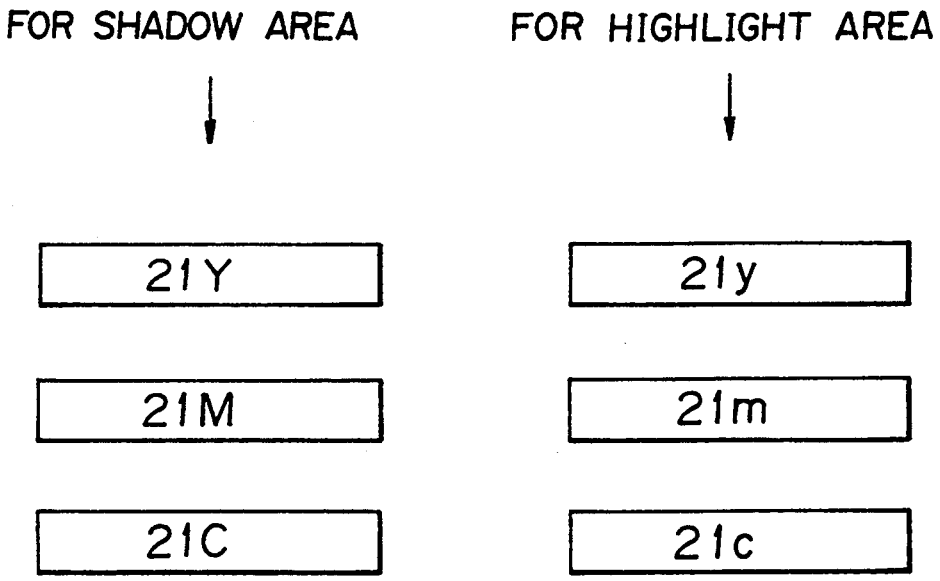
FIG. 3 is a diagram illustrative of a thermal transfer image forming method according to the present invention.

According to the thermal transfer image forming method of this invention, a full-color image is provided by arranging two sorts of three color thermal transfer sheets shown in FIG. 3; one sort includes three color thermal transfer sheets (yellow sheet 21Y, magenta sheet 21M and cyan sheet 21C) which are arranged to reproduce a desired black in shadow and the other sort includes three color thermal transfer sheets (yellow sheet **21*y*, magenta sheet 21*m* and cyan sheet 21*c*) which are arranged to reproduce a desired black in highlight. In other words, in this method are arranged three pairs of thermal transfer sheets each pair having different dye layers with respect to one and the same hue, respectively, (21Y and 21*y*, 21M and 21*m*, and 21C and 21*c***).

As for a means to impart heat energy at a time of thermal transfer operation using the conventional thermal transfer sheet and the thermal transfer image receiving sheet described above, any of known heat supplying means is usable therefor. For example, a recording apparatus such as a thermal printer (e.g., Video Printer VY-100 mfd. by Hitachi Seisakusho) imparts a heat energy of about 5 to 100 mJ/mm$^2$ to thermal transfer sheet while controlling a recording period of time to provide a desired image.

According to the thermal transfer image forming method of the present invention, an image is provided using the above mentioned thermal transfer sheets 21Y, 21M, 21C, **21*y*, 21*m* and 21*c* and thermal transfer image-receiving sheet. For example, in order to form a black mono-color image using three color thermal transfer sheets of yellow, magenta and cyan, one set of thermal transfer sheets suitable for reproducing a desired black in shadow including 21Y, 21M and 21C and the other set of thermal transfer sheets for highlight, likewise, including 21*y*, 21*m* and 21*c*** are selected to provide a gradation image in black. In other words, one and the same hue is reproduced in each area of shadow and highlight by selecting a different set of the three color thermal transfer sheets, respectively. For this reason, the thus obtained image is superior in the gradation characteristic without difference in a hue whether in shadow or in highlight.

In this case, also considering the reproductivity of other medium colors in shadow and in highlight, the two sets of three color thermal transfer sheets including one set of 21Y, 21M and 21C and the other set of **21*y*, 21*m* and 21*c*** can be used to provide an image in other medium colors superior in the gradation chartacteristic with little color difference. Various experiments may easily find selections and combinations of dyes for these two sets of three color thermal transfer sheets, The thermal transfer sheets used in the image forming method of this invention may include not only the two sets of thermal transfer sheets but additionally include another set of three color thermal transfer sheets for providing a middle tone area in a hue.

EXPERIMENTAL EXAMPLE

The present invention is described in more detail with reference to experimental examples hereunder. In the description and Tables, "part(s)" and "%" are based on weight reference, unless otherwise noted specifically.

EXPERIMENTAL EXAMPLE A

Sample A-1

A dye layer was prepared using a polyethylene terephthalate film having a thickness of 6 μm as a substrate film, one surface side of which is subjected to heat resistance treatment, by applying the following three color inks of Y, M and C for providing a shadow area end three color inks of y, m and c for a highlight area onto the other surface side of the substrate film sequentially in the above named order in a coating amount of 1.0 g/m$^2$ (after drying) by way of gravure printing, respectively and drying the coating, and then heating the same at 100° C. for two minutes to form a thermal transfer sheet of this invention (sample A-1) in a form of contiguous film.

| | |
|---|---|
| Ink Y for shadow: | |
| Yellow disperse dye (C.I. Disperse Yellow 201) | 4 parts |
| Ethylhydroxycellulose (mfd. by Hercules) | 5 parts |
| Toluene/isopropylalcohol (wt. ratio 1/1) | 80 parts |
| Ink M for shadow: | |
| Magenta disperse dye (C.I. Disperse Red 60) | 4 parts |
| Ethylhydroxycellulose (mfd. by Hercules) | 5 parts |
| Toluene/isopropylalcohol (wt. ratio 1/1) | 80 parts |
| Ink C for shadow: | |
| Cyan disperse dye (C.I. Solvent Blue 63 mfd. by Nihon Kayaku) | 4 parts |
| Ethylhydroxycellulose (mfd. by Hercules) | 5 parts |
| Toluene/isopropylalcohol (wt. ratio 1/1) | 80 parts |
| Ink y for highlight: | |
| Yellow disperse dye (Foron Brilliant Yellow 6GL mfd. by Sand) | 2 parts |
| Ethylhydroxycellulose (mfd. by Hercules) | 5 parts |
| Toluene/isopropylalcohol (wt. ratio 1/1) | 80 parts |
| Ink m for highlight: | |
| Magenta disperse dye (C.I. Solvent Red 19, mfd. by Nihon Kayaku) | 2 parts |
| Ethylhydroxycellulose (mfd. by Hercules) | 5 parts |
| Toluene/isopropylalcohol (wt. ratio 1/1) | 80 parts |
| Ink c for highlight: | |
| Cyan disperse dye (C.I. Solvent Blue 36, mfd. by Nihon Kayaku) | 2 parts |
| Ethylhydroxycellulose (mfd. by Hercules) | 5 parts |
| Toluene/isopropylalcohol (wt. ratio 1/1) | 80 parts |

Sample A-2

A thermal transfer sheet of this invention (sample A-2) was formed in the same manner as described with respect to the sample A-1 except that the following three color inks of y, m and c replace the three color inks for highlight used in Sample A-1.

| | |
|---|---|
| Ink y for highlight: | |
| Yellow disperse dye (Terasil Golden Yellow mfd. by CIBA GEIGY) | 1.5 parts |
| Ethylhydroxycellulose (mfd. by Hercules) | 5 parts |
| Toluene/isopropylalcohol (wt. ratio 1/1) | 80 parts |
| Ink m for highlight: | |
| Magenta disperse dye (C.I. Disperse Violet 26) | 2 parts |
| Ethylhydroxycellulose (mfd. by Hercules) | 5 parts |
| Toluene/isopropylalcohol (wt. ratio 1/1) | 80 parts |
| Ink c for highlight: | |
| Cyan disperse dye (C.I. Solvent Blue 36) | 2 parts |
| Ethylhydroxycellulose (mfd. by Hercules) | 5 parts |
| Toluene/isopropylalcohol (wt. ratio 1/1) | 80 parts |

Sample A-3

A thermal transfer sheet of this invention (sample A-3) was formed in the same manner as described with regard to sample A-1 except that the following three color inks of y, m and c replace the three color inks for highlight used in Sample A-1.

| | |
|---|---|
| Ink y for highlight: | |
| Yellow disperse dye (C.I. Disperse Yellow 141) | 2 parts |
| Ethylhydroxycellulose (mfd. by Hercules) | 5 parts |
| Toluene/isopropylalcohol (wt. ratio 1/1) | 80 parts |
| Ink m for highlight: | |
| Magenta disperse dye (C.I. Disperse Violet 73) | 2 parts |
| Ethylhydroxycellulose (mfd. by Hercules) | 5 parts |
| Toluene/isopropylalcohol (wt. ratio 1/1) | 80 parts |
| Ink c for highlight: | |
| Cyan disperse dye (Foron Brilliant Blue-S-R mfd. by Sand) | 1.5 parts |
| Ethylhydroxycellulose (mfd. by Hercules) | 5 parts |
| Toluene/isopropylalcohol (wt. ratio 1/1) | 80 parts |

Comparative Sample A-1

A thermal transfer sheet was formed as a comparative sample A-1, which comprises only the three color dye layers for shadow selected from sample A-1, i.e., excluding the dye layers for highlight.

Image-Receiving Sheet

Next, an image receiving sheet was formed using synthetic paper Yupo (having a thickness of 150 μm) as a substrate film, applying a coating material having the following composition for forming a receptor layer onto one surface side of the above substrate in a coating amount of 4.5 g/m$^2$ (after drying) and then drying the resultant coating under heating at 100° C. for half an hour.

| Composition of coating material for receptor layer | |
|---|---|
| Polyester resin (Vylon 103 mfd. by Toyobo) | 100 parts |
| Amino modified silicone oil (X-22-343 mfd. by Shin Etsu Kagaku Kogyo) | 3 parts |
| Epoxy modified silicone oil (XF-393 mfd. by Shin Etsu Kagaku Kogyo) | 3 parts |
| Toluene/methylethylketone (wt. ratio 1/1) | 500 parts |

Thermal Transfer Test

The thus formed thermal transfer sheets (sample A-1 to A-3) were, respectively, superposed on the above described image-receiving sheet with the dye layer of the former sheet facing the receptor layer of the latter sheet. In each case, an image was provided under the following conditions in a manner that the shadow area thereof was heated from the back surface of the thermal transfer sheet for shadow and the highlight area thereof is heated from the back surface of the thermal transfer sheet for highlight, respectively, by means of a thermal printing head (KMT-85-6, MPD2). The color difference between both areas of shadow and highlight and the quality of the resultant image were evaluated as shown in the following Table 1.

On the other hand, an image was formed using the comparative thermal transfer sheet (comparative sample A-1) in a manner that both the areas of shadow and highlight thereof were printed under the following conditions. The color difference between the areas of shadow and highlight and the quality of the resultant image were evaluated as in Table 1.

Image Forming Conditions

Impressed Voltage of thermal print head: 12.0 V

Pulse width: every 1 msec from 16.0 msec/line gradually decreased in a step-pattern Sub scanning direction: 6 line/mm (33.3 msec/line)

TABLE 1

| Thermal transfer sheet | Color difference* between shadow and highlight | | | | Image quality |
|---|---|---|---|---|---|
| | black | green | red | blue | |
| Sample A-1 | ◎ | ◎ | ◎ | ◎ | excellent |
| Sample A-2 | ◎ | ◎ | ◎ | ◎ | excellent |
| Sample A-3 | ◎ | ◎ | ◎ | ◎ | excellent |
| Comparative Sample A-1 | X | ○ | Δ | ○ | somewhat problematic |

*Evaluation standards
◎: excellent
○: substantially no problem
Δ: somewhat problematic
X: Difficult to be used

EXPERIMENTAL EXAMPLE B

Sample B-1C

A dye layer was prepared using a polyethylene terephthalate film having a thickness of 6 μm as a substrate film, one surface side of which is subjected to heat resistance treatment, by applying the following dye layer ink C for shadow onto the other surface side of the substrate film in a coating amount of 1.0 g/m$^2$ (after drying) by way of gravure printing and drying the coating, and then heating the same at 100° C. for two minutes to form thermal transfer sheet for shadow (sample B-1C) in a form of contiguous film corresponding to 21C in FIG. 3.

| Ink C for shadow: | |
|---|---|
| Foron Brilliant Blue-S-R (mfd. by Sand) | 4 parts |
| Ethylhydroxycellulose (mfd. by Hercules) | 5 parts |
| Toluene/isopropylalcohol (wt. ratio 1/1) | 80 parts |

Sample B-1Y

A thermal transfer sheet for shadow (sample B-1Y) corresponding to 21Y in FIG. 3 was prepared in the same manner as described with regard to sample B-1C, using a dye layer ink Y for shadow having the same composition as that of the ink C for shadow (sample B-1C) except exchanging the cyan dye for a yellow disperse dye (Macrolex Yellow 6G, mfd. by Bayer, C.I. Disperse Yellow 201).

Sample B-1M

A thermal transfer sheet for shadow (sample B-1M) corresponding to 21M in FIG. 3 was prepared in the same manner as described with regard to sample B-1C, using a dye layer ink M for shadow having the same composition as that of the ink C for shadow (sample B-1C) except exchanging the cyan dye for a magenta disperse dye (C.I. Disperse Red 60).

Sample B-1c

A thermal transfer sheet for highlight (sample B-1c), corresponding to 21c in FIG. 3, was prepared in the same msnenr as described with regard to sample B-1C, using the following dye layer ink c for highlight.

| Ink c for highlight: | |
|---|---|
| Kayaset blue 714 (mfd. by Nihon Kayaku, C.I. Solvent Blue-63) | 2 parts |
| Ethylhydroxycellulose (mfd. by Hercules) | 5 parts |
| Toluene/isopropylalcohol (wt. ratio 1/1) | 80 parts |

Sample B-1y

A thermal transfer sheet for highlight (sample B-1y), corresponding to 21*y* in FIG. 3, was prepared in the same manner as described with regard to sample B-1c, using an ink y for highlight having the same composition as that of the ink c for highligth (sample B-1c) except that a yellow disperse dye (Foron Brilliant Yellow 6GL) replaces the cyan dye.

Sample B-1m

A thermal transfer sheet for highlight (sample B-1m), corresponding to 21*m* in FIG. 3, was prepared in the same manner as described with regard to sample B-1c, using an ink m for highlight having the same composition as that of the ink c for highligth (sample B-1c) except that a magenta disperse dye (MS Red G) replaces the cyan dye.

Sample B-2S, B-2H

A thermal transfer sheet for shadow (sample B-2S) and s thermal transfer sheet for highlight (sample B-2H) were tapered in the same manner as described with regard to sample B-1Y, using the following inks of three colors mixture type in place of the ink used in sample B-1Y, respectively.

| Ink S for shadow: | |
|---|---|
| Macrolex Yellow 6G (mfd. by Bayer) | 1.41 parts |
| Baymicron SN-2167 (mfd. by Bayer) | 1.52 parts |
| Kayaset Blue 714 (mfd. by Nihon Kayaku, C.I. Solvent Blue 63) | 5.53 parts |
| Polyvinyl butyral (Esrec BX-1, mfd. by Sekisui Kagaku) | 4.5 parts |
| Isopropylalcohol | 43.7 parts |
| Toluene | 43.7 parts |
| Ink H for highlight: | |
| Terasil Golden Yellow 2SR (mfd. by CIBA GEIGY) | 0.38 part |
| Solvent Violet 14 (mfd. by Orient) | 0.82 part |
| Kayaset Blue 714 (mfd. by Nihon Kayaku, C.I. Solvent Blue 63) | 0.80 part |
| Polyvinyl butyral (Esrec BX-1 mfd. by Sekisui Kagaku) | 4.5 parts |
| Isopropylalcohol | 46.75 parts |
| Toluene | 46.75 parts |

Sample B-3Y, B-3C, B-3M

Thermal transfer sheets for shadow (sample B-3Y, B-3C and B-3M) were prepared in the same manner as described with regard to sample B-1, using the following three sorts of inks in place of the three sorts of inks Y, C and M used in sample B-1Y, B-1C and B-1M, respectively.

| Ink Y for shadow: | |
|---|---|
| Foron Brilliant Yellow S-6GL (mfd. by Sand) | 3.0 parts |
| Polyvinyl butyral (Esrec BX-1, mfd. by Sekisui Kagaku) | 4.5 parts |
| Isopropylalcohol | 46.25 parts |
| Toluene | 46.25 parts |

-continued

| Ink C for shadow: | |
|---|---|
| Foron Brilliant Blue S-R (mfd. by Sand) | 3.0 parts |
| Polyvinyl butyral (Esrec BX-1, mfd. by Sekisui Kagaku) | 4.5 parts |
| Isopropylalcohol | 46.25 parts |
| Toluene | 46.25 parts |
| Ink M for shadow: | |
| Disperse dye (C.I. Disperse Red 60) | 4.0 parts |
| Polyvinyl butyral (Esrec BX-1, mfd. by Sekisui Kagaku) | 4.5 parts |
| Isopropylalcohol | 46.25 parts |
| Toluene | 46.25 parts |

Sample B-3G

A thermal transfer sheet for highlight (sample B-3G) was prepared in the same manner as described with regard to sample B-1Y, using the following ink G of two colors mixture type in place of the ink used in sample B-1Y.

| Ink G for highlight: | |
|---|---|
| Foron Brilliant Blue S-R (mfd. by Sand) | 3.0 parts |
| Foron Brilliant Yellow S-6GL (mfd. by Sand) | 3.0 parts |
| Polyvinyl butyral (Esrec BX-1, mfd. by Sekisui Kagaku) | 4.5 parts |

Thermal Transfer Test

Images were provided using the respective thermal transfer sheets prepared as described above and the same image receiving sheet as that prepared in experimental example A.

Thermal Transfer Test 1

An image was provided under the same conditions as described with regard to experimental example A, using six sorts of thermal transfer sheets (sample B-1Y, B-1M, B-1C, B-1y, B-1m and B-1c) and the above mentioned image-receiving sheet; the thermal transfer sheets are superposed on the image-receiving sheet with the dye layers of the former sheets facing the receptor layer of the latter sheet, and a shadow area thereof was provided by heating from the back surface side of the thermal transfer sheets for shadow (sample B-1Y, B-1M and B-1C), and a highlight area thereof was provided by heating from the back surface side of the thermal transfer sheets for highlight (sample B-1*y*, B-1m or B-1c) by means of a thermal printing head according to the thermal transfer image forming method of this invention. The color difference between both areas of shadow and highlight and the quality of the resultant images were evaluated as shown in Table 2.

Thermal Transfer Test 2

An images was provided under the same conditions as described with regard to the above thermal transfer test 1 using two sorts of thermal transfer sheets (sample B-2S, B-2H) and the image-receiving sheet; the thermal transfer sheets were superposed on the image-receiving sheet with the dye layers of the former sheets facing the receptor layer of the latter sheet, and a shadow area thereof was provided using the thermal transfer sheet for shadow (sample B-2S) and a highlight area thereof is provided using the thermal transfer sheet for highlight (sample B-2H) according to the thermal transfer image forming method of this invention. The results were shown in Table 2.

Thermal Transfer Test 3

A green mono-color image was prepared under the same condition as described with regard to thermal transfer test 1, using four sorts of thermal transfer sheets (sample B-3Y, B-3M, B-3C and sample B-3G) and the image-receiving sheet; the thermal transfer sheets are superposed on the image receiving sheet with the dye layers of the former sheets facing the receptor layer of the latter sheet, and a shadow area thereof was provided using the thermal transfer sheets for shadow (sample B-3Y, B-3M, B-3C) and a highlight area thereof was provided using the thermal transfer sheet for highlight (Sample B-3G) according to the image forming method of this invention. The results were shown in Table 2.

Comparative Thermal Transfer Test 1

An image was provided under the same conditions as described with regard to thermal transfer test 1 using three sorts of thermal trasnfer sheets (sample B-1Y, B-1M, B-1C) so as to provide both areas of shadow and highlight thereof according to a conventional image forming method. The result was shown in Table 2.

Comparative Thermal Transfer Test 2

An image was provided under the same condition as described with regard to thermal transfer test 1 using a thermal transfer sheet (sample B-2S) so as to provide both areas of shadow and highlight thereof according to the conventional image forming method, The result was shown in Table 2.

TABLE 2

| Thermal transfer test | Color difference* between shadow and highlight | | | | Image quality |
|---|---|---|---|---|---|
| | black | green | red | blue | |
| 1 | ◎ | ◎ | ◎ | ◎ | excellent |
| 2 | ◎ | — | — | — | excellent |
| 3 | | ◎ | — | — | excellent |
| Comparative test 1 | X | ○ | ○ | ○ | somewhat problematic |
| Comparative test 2 | X | — | — | — | difficult to be used |

*Evaluation standards
◎: excellent
○: no problem
Δ: somewhat problematic
X: difficult to be used

EXPERIMENTAL EXAMPLE C

Sample C-S, C-H

A dye layer was prepared using a polyethylene terephthalate film having a thickness of 4.5 μm as a substrate film, one surface side of which was subjected in heat-resistance treatment, by applying the following dye layer ink S of three-colors-mixture type for shadow onto the other surface side of the substrate film in a coating amount of 1.0 g/m$^2$ (after drying) by way of gravure printing, and roughly drying by hot air and further heating the coating at 80° C. for five minutes to form a thermal transfer sheet for shadow (sample C-S) in a form of contiguous film. Similarly, a thermal transfer sheet for highlight (sample C-H) was prepared using the following dye layer ink H of three-colors-mixture type for highlight.

| | |
|---|---|
| Ink S for shadow: | |
| Yellow disperse dye (Terasil Golden Yellow 2RS mfd. by CIBA-GELGY) | 0.38 parts |
| Magenta disperse dye (Solvent Violet 14 mfd. by Orient) | 0.82 parts |
| Cyan disperse dye (Kayaset Blue 714 mfd. by Nihon Kayaku) | 0.80 parts |
| Polyvinylbutyral (Esrec BX-1 mfd. by Sekisui Kagaku) | 4.5 parts |
| Methylethylketone | 46.75 parts |
| Toluene | 46.75 parts |
| Ink H for highlight: | |
| Yellow disperse dye (Macrolex Yellow 6G mfd. by Bayer) | 1.41 parts |
| Magenta disperse dye (Baymicron SN-2670 mfd. by Bayer) | 1.52 parts |
| Cyan disperse dye (Kayaset Blue 714 mfd. by Nihon Kayaku) | 5.53 parts |
| Polyvinylburyral (Esrec BX-1 mfd. by Sekisui Kagaku) | 4.5 parts |
| Methylethylketone | 43.7 parts |
| Toluene | 43.7 parts |

In the next step, a black and white image was provided using the above-mentioned thermal transfer sheets (sample C-H, C-S) and the same image-receiving sheet as that prepared in experimental example A. More specifically, image I was provided under the following conditions in a manner that the thermal transfer sheets were superposed on the image-receiving sheet with the dye layers of the former sheets facing the receptor layer of the latter sheet, and a shadow area thereof was provided using the thermal transfer sheet for shadow (sample C-S) and a highlight area thereof was provided using the thermal transfer sheet for highlight (sample C-H) according to the image forming method of this invention.

Image Forming Conditions

Thermal sublimation transfer printer: Hitachi, Seisakusho VY-50

Printing energy: 90 mJ/mm$^2$

Printing image: gradation density printing

"Shadow area" was determined as an area having optical density (OD) of 1 or more and "highlight area" was as an area having OD of 0 to 1. "OD" was measured by RD-918 mfd. by Macbes Co., Ltd.

For comparison therewith, image II was provided under the same conditions using one and the same thermal transfer sheet (sample C-S) for providing both areas of shadow and highlight.

Thus formed images I and II have the respective chromaticity values (L, a, b) measured by a colorimeter (CM-1000R mfd. by Minolta) at four density levels every 0.5 from 0.5 to 2.0 (OD=0.5, 1.0, 1.5, 2.0) and respective color differences ΔE calculated according to the following formula. The results were shown in Table 3.

$$\Delta E = \sqrt{(a - a_0)^2 + (b - b_0)^2}$$

a, b: measured value of an image-printed area $a_0$, $b_0$: measured value of an area other than the image-printed area (surface of an image-receiving sheet)

Table 3 shows, the image I formed according to the present invention has less color difference ΔE than the image II and can be reproduced with the color difference being 2.0 or less (ΔE≦2.0). The effect of the present invention is distinguished particularly in forming images at medium or low density level (OD=0.5, 1.0).

TABLE 3

| Image | color difference ΔE | | | |
|---|---|---|---|---|
| | OD = 0.5 | OD = 1.0 | OD = 1.5 | OD = 2.0 |
| I (according to the present invention | 0.79 | 1.21 | 1.67 | 1.15 |
| II (comparative example) | 3.45 | 4.51 | 1.67 | 1.15 |

Experimental Example D

Sample D-G

A dye layer was prepared using a polyethylene terephthalate film having a thickness of 4.5 μm as a substrate film, one surface side of which is subjected to heat-resistance treatment, by applying the following dye layer ink G of two-colors-mixture type onto the other surface side of the substrate in a coating amount of 1.0 g/m$^2$ (after drying) by means of a wire bar coater, and drying roughly by hot air and heating the coating at 80° C. for five minutes to thereby provide a thermal transfer sheet of this invention (sample D-G) in a form of contiguous film.

| Ink G: | |
|---|---|
| Cyan disperse dye (Foron Brilliant Blue S-R mfd. by Sand) | 1.6 parts |
| Yellow disperse dye (Foron Brilliant Yellow S-6GL mfd. by Sand) | 0.9 parts |
| Polyvinylbutyral (Esrec BX-1 mfd. by Sekisui Kagaku) | 46.5 parts |
| Toluene | 46.5 parts |

Comparative Sample D-Y, D-C

A comparative yellow thermal transfer sheet (comparative sample D-Y) and a comparative cyan thermal transfer sheet (comparative sample D-C) were prepared, respectively, in the same manner as described with regard to sample D-G except that an yellow dye layer ink Y or a cyan dye layer ink C having, respectively, the following compositions replace the ink G used in sample D-G.

| Yellow dye layer ink Y | |
|---|---|
| Yellow disperse dye (Foron Brilliant Yellow S-6GL mfd. by Sand) | 3.0 parts |
| Polyvinylbutyral (Exrec BX-1 mfd. by Sekisui Kagaku) | 4.5 parts |
| Methylethyl ketone | 46.25 parts |
| Toluene | 46.25 parts |
| Cyan dye layer ink C: | |
| Cyan disperse dye (Foron Brilliant Blue S-R mfd. by Sand) | 3.0 parts |
| Polyvinylbutyral (Esrec BX-1 mfd. by Sekisui Kagaku) | 4.5 parts |
| Methyethyl ketone | 46.25 parts |
| Toluene | 46.25 parts |

In the next step, a gradation print-out in a green monocolor was provided using the above-mentioned thermal transfer sheets and the same image-receiving sheet as prepared in experimental example A. More specifically, the print-out was formed in a manner that the thermal transfer sheet (sample D-G) was suppersosed on the image-receiving sheet with the dye layer of the former sheet facing the receptor layer of the latter sheet and supplied with a printing energy changing at four levels (21, 42, 63 and 84 mJ/mm$^2$) by means of a thermal sublimation transfer printer-VY-50 (mfd. by Hitachi Seisakusho).

For comparison therewith, gradation print-outs were provided similarly using the other thermal transfer sheets (sample D-Y and D-C).

The thus formed print-outs have, respectively, chromaticity values (L, a, b) measured by a colorimeter (CM-1000R mfd. by Minolta) and color differences Δθ between the chromaticity value at the highest density level (printing energy of 84 mJ/mm$^2$) and those at the different density levels calculated according to the following formula. The results were shown in Table 4.

$$\Delta\theta = |\theta - \theta|$$

$$\tan\theta = (b - b_0)/(a - a_0)$$

*a, b:* measured value of a print-out $a_0$, $b_0$: measured value of an area other than the print-out (surface of a image-receiving sheet)

$\theta_0$: $\theta$ at 84 mJ/mm$^2$

TABLE 4

| Thermal transfer sheet | Color difference Δθ | | | |
|---|---|---|---|---|
| | 21 mJ/mm$^2$ | 42 mJ/mm$^2$ | 63 mJ/mm$^2$ | 84 mJ/mm$^2$ |
| Sample D-G | 2.2 | 0.8 | 0.4 | 0 |
| Comparative sample D-Y | 1.5 | 4.6 | 1.6 | 0 |
| Comparative sample D-Y | | | | |

Referring to Table 4, when the thermal transfer sheet (sample D-G) of the present invention is used, the color differences Δθ are small at almost every gradation level, which clearly shows no need for controlling printing energy at every level of density. On the other hand, when the comparative thermal transfer sheets are used, the color differences Δθ are rather large, particularly at low and medium gradation levels, which shows, unless printing energy is controlled at every level of density, a print-out could not be formed in a stable hue.

The invention may be embodied in other specific forms without departing from the spirit or essential characteristics thereof. The above-mentioned embodiment is therefore to be considered in all respects as illustrative and not restrictive, the scope of the invention being indicated by the appended claims rather than by the foregoing description and all changes which came within the meaning and range of equivalency of the claims are therefore intended to be embraced therein.

What is claimed is:

1. A thermal transfer image forming method capable of gradation-recording by controlling a heat energy in which a thermal transfer sheet having a substrate film and a dye layer containing a dye and a binder on the surface side of the substrate film is superposed on an image-receiving sheet and the thermal transfer sheet is supplied with heat in imagewise shape from the back surface side of the substrate film to form an image on the image-receiving sheet, the method comprising the steps of:

preparing a first thermal transfer sheet provided with a dye layer for a shadow area having an optical density, OD, of not less than 1, and a second thermal transfer sheet provided with a dye layer for a highlight area having an optical density, OD, of not more than 1, with respect to a same hue; said dye layers for shadow and highlight area containing different dyes from each other, forming a heavy density portion of the same hue by use of the first thermal transfer sheet for the shadow area; and forming a light density portion of the same hue by use of the second thermal transfer sheet for the highlight area.

2. A thermal transfer image forming method according to claim 1, wherein each of the first and second thermal transfer sheets comprises a thermal transfer sheet having a dye layer containing a yellow dye, a thermal transfer sheet having a dye layer containing a magenta dye and a thermal transfer sheet having a dye layer containing a cyan dye.

3. A thermal transfer image forming method according to claim 1, wherein each of the first and second thermal transfer sheets comprises a thermal transfer sheet having a dye layer containing at least two dyes selected from the group consisting of yellow dye, magenta dye and cyan dye.

4. A thermal transfer image forming method according to claim 1, wherein each of the first and second thermal transfer sheets comprises a thermal transfer sheet having a dye layer containing three dyes selected from the group consisting of yellow dye, magenta dye and cyan dye, a thermal transfer sheet having a dye layer containing a yellow dye, a thermal transfer sheet having a dye layer containing a magenta dye and a thermal transfer sheet having a dye layer containing a cyan dye.

5. A thermal transfer image forming method according to claim 1, wherein the dye layers for shadow and highlight area contain different dye or different combination of dyes.

6. A thermal transfer image forming method capable of gradation-recording by controlling heat energy in which a thermal transfer sheet having a substrate film and a dye layer containing a dye and a binder on the surface side of the substrate film is superposed on an image-receiving sheet and the thermal transfer sheet is supplied with heat in imagewise shape from the back surface side of the substrate film to form an image on the image-receiving sheet, the method comprising the steps of:

preparing a thermal transfer sheet provided with a first dye layer for a shadow area having an optical density, OD, of not less than 1, and a second dye layer for a highlight area having an optical density, OD, of not more than 1, the first and second dye layers being disposed adjacently on one surface of the substrate film, with respect to a same hue; said dye layers for shadow and highlight area containing different dyes from each other, forming a heavy density portion of the same hue by use of the first dye layer for the shadow area; and forming a light density portion of the same hue by use of the second dye layer for the highlight area.

7. A thermal transfer image forming method according to claim 6, wherein the dye layers comprise dye layers of three colors of yellow, magenta and cyan, and comprise the first dye layer for the shadow area and the second dye layer for the highlight area with respect to at least one color of the three colors.

8. A thermal transfer image forming method according to claim 7, wherein each of the dye layers of three colors of yellow, magenta and cyan, comprises two sorts of the first dye layer for the shadow area and the second dye layer for the highlight area.

9. A thermal transfer image forming method according to claim 6, each of the first and second dye layers comprises dyes including three dyes selected from the group consisting of yellow dye, magenta dye and cyan dye.

10. A thermal transfer image forming method according to claim 6, each of the first and second dye layers comprises a dye layer containing a yellow dye, a dye layer containing a magenta dye and a dye layer containing a cyan dye, and a dye layer containing three dyes selected from the group consisting of yellow dye, magenta dye and cyan dye.

11. A thermal transfer image forming method according to claim 6, wherein the dye layers for shadow and highlight area contain different dye or different combination of dyes.

* * * * *